US008228251B1

(12) United States Patent
Behdad et al.

(10) Patent No.: US 8,228,251 B1
(45) Date of Patent: Jul. 24, 2012

(54) ULTRA-WIDEBAND, LOW PROFILE ANTENNA

(75) Inventors: Nader Behdad, Madison, WI (US); Mudar Alaa Al-Joumayly, Madison, WI (US); Moshen Salehi, Blacksburg, VA (US)

(73) Assignees: University of Central Florida Research Foundation, Inc., Orlando, FL (US); Wisconsin Alumni Research Foundation, Madison, WI (US)

( * ) Notice: Subject to any disclaimer, the term of this patent is extended or adjusted under 35 U.S.C. 154(b) by 133 days.

(21) Appl. No.: 12/861,053

(22) Filed: Aug. 23, 2010

(51) Int. Cl.
*H01Q 11/12* (2006.01)
*H01Q 21/00* (2006.01)

(52) U.S. Cl. ..... 343/742; 343/867; 343/846

(58) Field of Classification Search ..... 343/742, 343/866, 867, 846
See application file for complete search history.

(56) References Cited

U.S. PATENT DOCUMENTS

| | | | | |
|---|---|---|---|---|
| 4,982,197 | A | 1/1991 | Villaseca et al. | |
| 5,304,998 | A | 4/1994 | Lopez | |
| 5,666,126 | A | 9/1997 | Lange | |
| 5,852,421 | A | 12/1998 | Maldonado | |
| 6,014,107 | A * | 1/2000 | Wiesenfarth | 343/742 |
| 6,163,302 | A | 12/2000 | Bjorkengren et al. | |
| 6,329,955 | B1 | 12/2001 | McLean et al. | |
| 6,336,036 | B1 | 1/2002 | Hayes | |
| 6,348,897 | B1 | 2/2002 | Alameh et al. | |
| 6,720,929 | B2 | 4/2004 | Nybeck et al. | |
| 7,268,741 | B2 | 9/2007 | Sarabandi et al. | |
| 2004/0090372 | A1 | 5/2004 | Nallo et al. | |
| 2006/0012535 | A1 | 1/2006 | McLean | |
| 2009/0153303 | A1 | 6/2009 | Forster | |

FOREIGN PATENT DOCUMENTS

WO WO 2005/011050 A2 2/2005

OTHER PUBLICATIONS

International Search Report and Written Opinion received in PCT/US2011/038560, Apr. 26, 2012.

* cited by examiner

*Primary Examiner* — Hoang V Nguyen
(74) *Attorney, Agent, or Firm* — Bell & Manning, LLC

(57) ABSTRACT

An ultra-wideband, low profile antenna is provided. The antenna includes a ground plane substrate and a radiating element. The radiating element includes at least two loop sections, wherein each of the at least two loop sections is electrically connected to a feed network and to the ground plane substrate. The radiating element is configured to radiate over a first frequency band when the feed network provides an in-phase input signal to the at least two loop sections and to radiate over a second frequency band when the feed network provides an out-of-phase input signal to the at least two loop sections. The second frequency band includes a lower frequency than the first frequency band.

31 Claims, 17 Drawing Sheets

ULTRA-WIDEBAND, LOW PROFILE ANTENNA

REFERENCE TO GOVERNMENT RIGHTS

This invention was made with United States government support under W911QX-08-C-0093 awarded by the ARMY/ARL. The United States government has certain rights in the invention.

BACKGROUND

In some applications, ultra-wide band antennas are needed to operate at very low frequencies, for example, at or below the ultra high frequency band. At such frequencies, the electromagnetic wavelength is very large. Consequently, any antenna that is used at these frequencies will be physically very large. This physically large dimension, i.e. 30-40 feet, may result in a very high antenna that protrudes from a support object, such as a vehicle, and that can be easily seen.

An "electrically-small" antenna refers to an antenna or antenna element with relatively small geometrical dimensions compared to the wavelength of the electromagnetic fields the antenna radiates. Electrically-small antenna elements may be used in low frequency applications to overcome issues associated with the physical size of the antenna required based on the wavelength. Unfortunately, electrically small antennas tend to have relatively large radiation quality factors meaning that they tend to store, based on a time average, much more energy than they radiate resulting in very low radiation efficiencies.

SUMMARY

In an illustrative embodiment, an ultra-wideband, low profile antenna is provided. The antenna includes a ground plane substrate and a radiating element. The radiating element includes at least two loop sections, wherein each of the at least two loop sections is electrically connected to a feed network and to the ground plane substrate. The radiating element is configured to radiate over a first frequency band when the feed network provides an in-phase input signal to the at least two loop sections and to radiate over a second frequency band when the feed network provides an out-of-phase input signal to the at least two loop sections. The second frequency band includes a lower frequency than the first frequency band.

In another illustrative embodiment, an ultra-wideband, low profile antenna is provided. The antenna includes a ground plane substrate, a first radiating element, and a second radiating element. The ground plane substrate is formed of at least four magneto-dielectric materials having different surface impedances. The first radiating element includes two loop sections, wherein each of the two loop sections of the first radiating element is electrically connected to a feed network and to the ground plane substrate. The second radiating element includes two loop sections wherein each of the two loop sections of the second radiating element is electrically connected to the feed network and to the ground plane substrate. Each of the two loop sections of the first radiating element and each of the two loop sections of the second radiating element is electrically connected to a different magneto-dielectric material of the ground plane substrate. The feed network provides an input signal to each loop section of the first radiating element and of the second radiating element, where the input signal to each has a different phase selected to define a direction of a radiation pattern generated by the first radiating element and the second radiating element.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
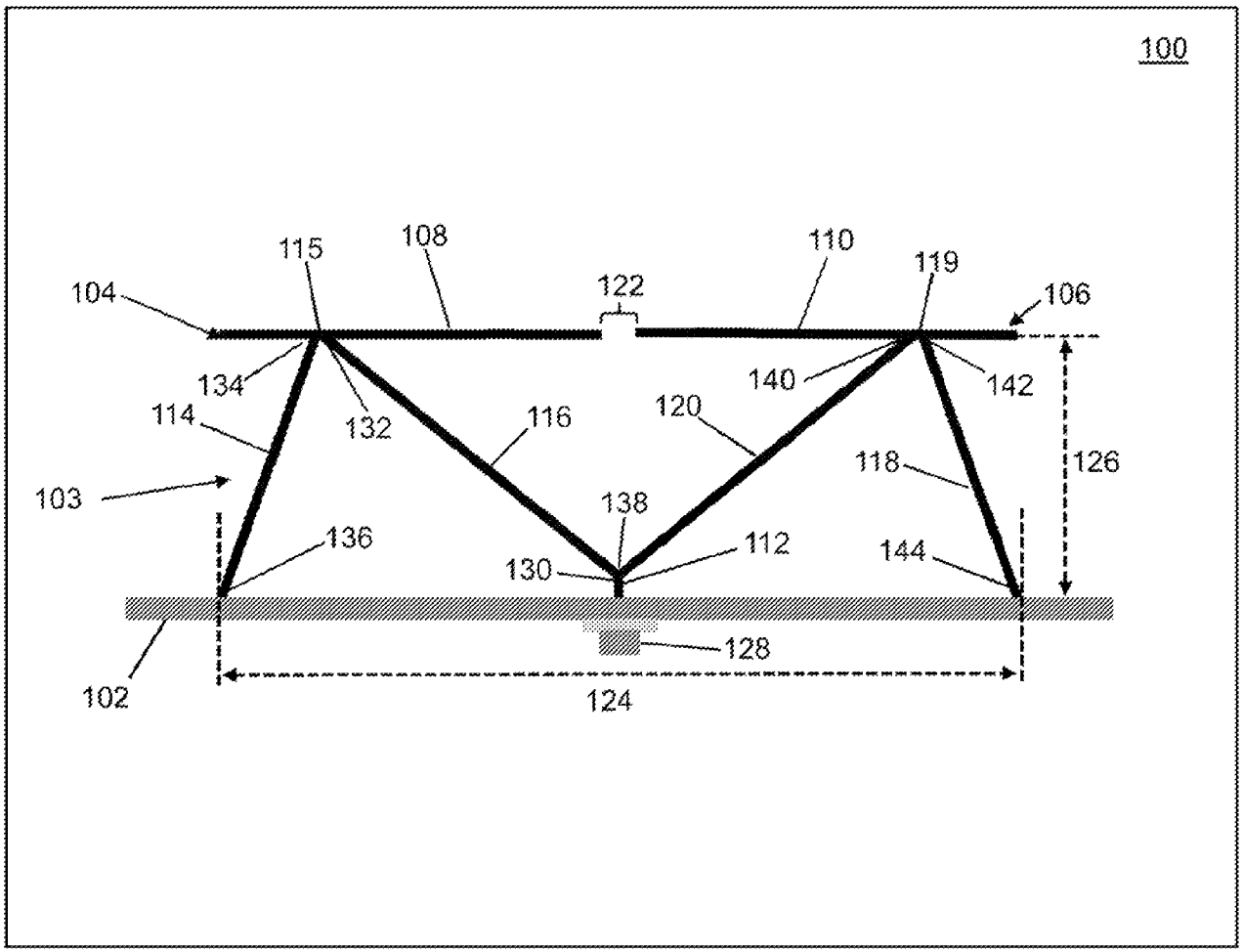
FIG. 1 is a side view of an antenna in accordance with an illustrative embodiment.

With reference to FIG. 1, a side view of an antenna 100 is shown in accordance with an illustrative embodiment. Antenna 100 may include a ground plane substrate 102 and a radiating element 103. Ground plane substrate 102 is electrically grounded and may be formed of any material suitable for forming an electrical ground for antenna 100. For example, ground plane substrate 102 may be formed of a metal sheet alone or with a dielectric or magnetic material or a magneto-dielectric material on a top surface of the metal sheet. Radiating element 103 may include a first loop section 104 and a second loop section 106. First loop section 104 and second loop section 106 may be formed of any conducting material suitable for forming a radiator of antenna 100. For example, first loop section 104 and second loop section 106 may be formed of copper or brass sheets among many other options as known to a person of skill in the art. First loop section 104 and second loop section 106 may be formed of the same or different materials. First loop section 104 may include a first section 116, a second section 114, and a third section 108. First section 116, second section 114, and third section 108 of first loop section 104 may be formed of the same or different materials. Second loop section 106 may include a first section 120, a second section 118, and a third section 110. First section 120, second section 118, and third section 110 of second loop section 106 may be formed of the same or different materials.

First section 116 of first loop section 104 includes a first end 130 and a second end 132, wherein first end 130 is electrically connected to a feed network 128 through a feed 112. Second section 114 of first loop section 104 includes a third end 134 and a fourth end 136, wherein third end 134 is mounted to second end 132 of first section 116 of first loop section 104, and fourth end 136 is mounted to ground plane substrate 102. In other embodiments, first section 116 and second section 114 of first loop section 104 are formed of the same section which is bent to form the structure shown with reference to FIG. 1. Third section 108 of first loop section 104 is mounted to second end 132 of first section 116 of first loop section 104 and third end 134 of second section 114 of first loop section 104 along a first edge 115. As used in this disclosure, the term "mount" includes join, unite, connect, associate, insert, hang, hold, affix, attach, fasten, bind, paste, secure, bolt, screw, rivet, solder, weld, glue, form over, layer, and other like terms. The phrases "mounted on" and "mounted to" include any interior or exterior portion of the support member referenced.

First section 120 of second loop section 106 includes a first end 138 and a second end 140, wherein first end 138 is electrically connected to feed network 128 through feed 112. Second section 118 of second loop section 106 includes a third end 142 and a fourth end 144, wherein third end 142 is mounted to second end 140 of first section 120 of second loop section 106, and fourth end 144 is mounted to ground plane substrate 102. In other embodiments, first section 120 and second section 118 of second loop section 106 are formed of the same section which is bent to form the structure shown with reference to FIG. 1. Third section 110 of second loop section 106 is mounted to second end 140 of first section 120 of second loop section 106 and third end 142 of second section 118 of second loop section 106 along a second edge 119. A gap 122 is formed between third section 108 of first loop section 104 and third section 110 of second loop section 106. Feed 112 further includes a gap (shown with reference to FIGS. 2 and 3) between first end 130 of first section 116 of first loop section 104 and first end 138 of first section 120 of second loop section 106. Gap 122 and the gap between first end 130 of first section 116 of first loop section 104 and first end 138 of first section 120 of second loop section 106 may have the same or different widths.

Third end 134 of second section 114 of first loop section 104 is mounted to second end 132 of first section 116 of first loop section 104 such that first section 116 and second section 114 of first loop section 104 form two sides of a triangle extending above ground plane substrate 102 when projected into a first plane perpendicular to a second plane defined by ground plane substrate 102 and extending through ground plane substrate 102 as shown with reference to FIG. 1. Third end 142 of second section 118 of second loop section 106 is mounted to second end 140 of first section 120 of second loop section 106 such that first section 120 and second section 118 of second loop section 106 form two sides of a triangle extending above ground plane substrate 102 when projected into the first plane perpendicular to the second plane defined by ground plane substrate 102 and extending through ground plane substrate 102 as shown with reference to FIG. 1.

A length 124 of radiating element 103 between fourth end 136 of second section 114 of first loop section 104 and fourth end 144 of second section 118 of second loop section 106 may be approximately $0.18\lambda_{min}$ where $\lambda_{min}$ is a wavelength at a lowest design frequency of antenna 100. In an illustrative embodiment, third section 108 of first loop section 104 and third section 110 of second loop section 106 are generally planar and oriented in a third plane approximately parallel to the second plane defined by ground plane substrate 102. A height 126 of radiating element 103 between the second plane and the third plane may be approximately $0.07\lambda_{min}$.

Figure 2:
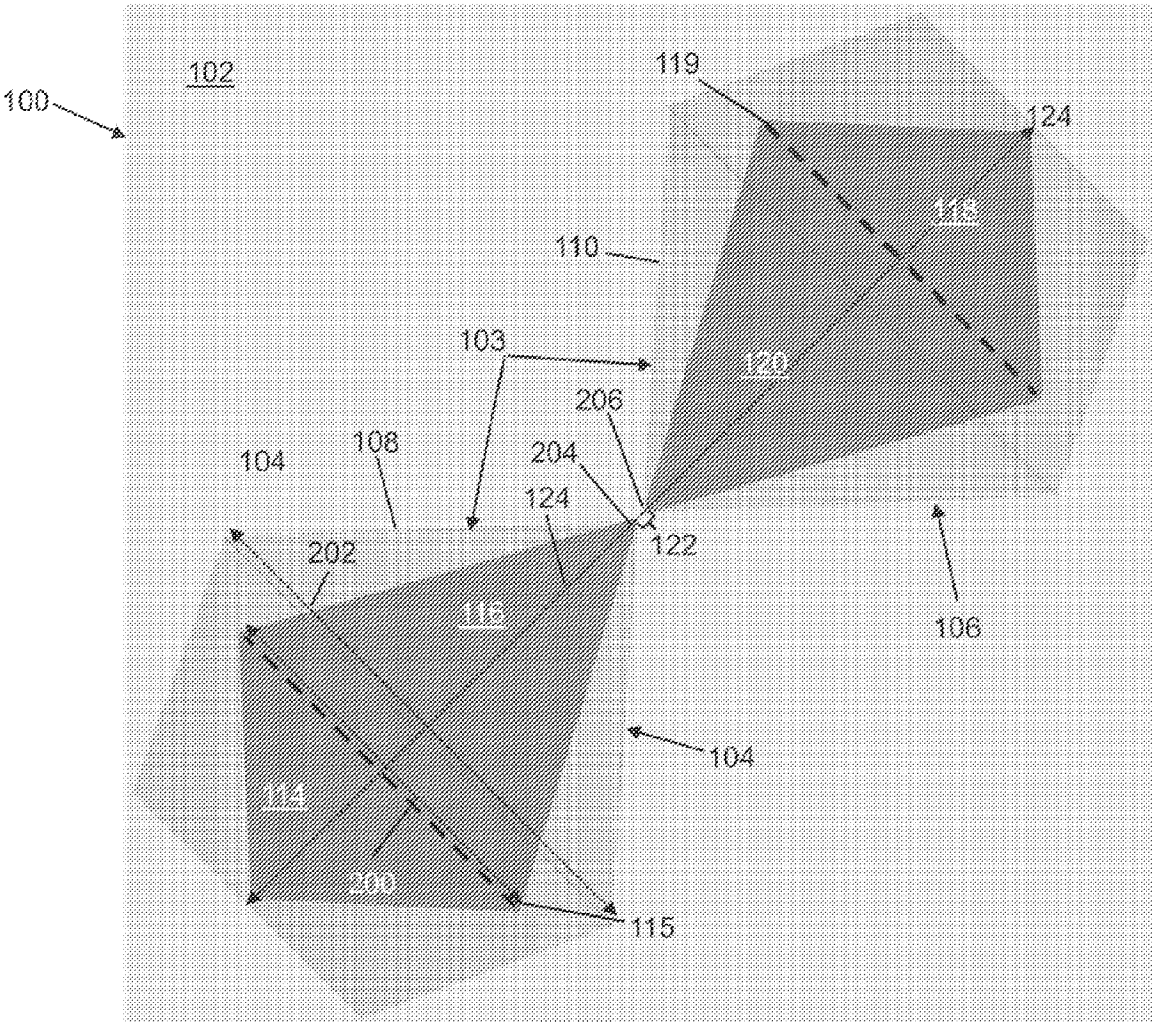
FIG. 2 is a top view of the antenna of FIG. 1 in accordance with an illustrative embodiment.

With reference to FIG. 2, a top view of antenna 100 is shown in accordance with an illustrative embodiment. In the illustrative embodiment of FIG. 2, third section 108 of first loop section 104 and third section 110 of second loop section 106 have a pentagon shape when projected into the second plane defined by ground plane substrate 102. Third section 108 of first loop section 104 and third section 110 of second loop section 106 may form other polygonal shapes than those shown in the illustrative embodiments.

In the illustrative embodiment of FIG. 2, first section 116 and second section 114 of first loop section 104 together have a quadrilateral shape when projected into the second plane defined by ground plane substrate 102, and first section 120 and second section 118 of second loop section 106 together have a quadrilateral shape when projected into the second plane defined by ground plane substrate 102. First section 116 and second section 114 of first loop section 104 and first section 120 and second section 118 of second loop section 106 may form other polygonal shapes than those shown in the illustrative embodiments. More specifically, in the illustrative embodiment of FIG. 2, first section 116 and second section 114 of first loop section 104 together have a deltoid shape when projected into the second plane defined by ground plane substrate 102, and first section 120 and second section 118 of second loop section 106 together have a deltoid shape when projected into the second plane defined by ground plane substrate 102, where a deltoid is a quadrilateral with two disjoint pairs of congruent adjacent sides, in contrast to a parallelogram, where the sides of equal length are opposite.

In the illustrative embodiment of FIG. 2, first edge 115 is a diagonal of the quadrilateral shape formed by first section 116 and second section 114 of first loop section 104, and second edge 119 is a diagonal of the quadrilateral shape formed by first section 120 and second section 118 of second loop section 106. In an illustrative embodiment, first edge 115 and second edge 119 have a first length 200 in a range from approximately $0.05\lambda_{min}$ to approximately $0.1\lambda_{min}$ depending on the shape. In the illustrative embodiment of FIG. 2, a diagonal of the pentagon shape formed by third section 108 of first loop section 104 and a diagonal of the pentagon shape formed by third section 110 of second loop section 106 and generally parallel to first edge 115 and second edge 119 have a second length 202 of in a range from approximately $0.07\lambda_{min}$ to approximately $0.14\lambda_{min}$ depending on the shape.

Second loop section 106 is mounted as a mirror image of first loop section 104 with gap 122 positioned between a first end point 204 of first loop section 104 and a second end point 206 of second loop section 106. First end point 204 is at a tip of the long edges of the deltoid shape formed by first section 116 and second section 114 of first loop section 104. First end point 204 may also include a tip of the pentagon shape formed by third section 108 of first loop section 104. Second end point 206 is at a tip of the long edges of the deltoid shape formed by first section 120 and second section 118 of second loop section 106. Second end point 206 may also include a tip of the pentagon shape formed by third section 110 of second loop section 106. In the illustrative embodiment of FIG. 2, gap 122 has a length of approximately $0.005\lambda_{min}$.

Figure 3:
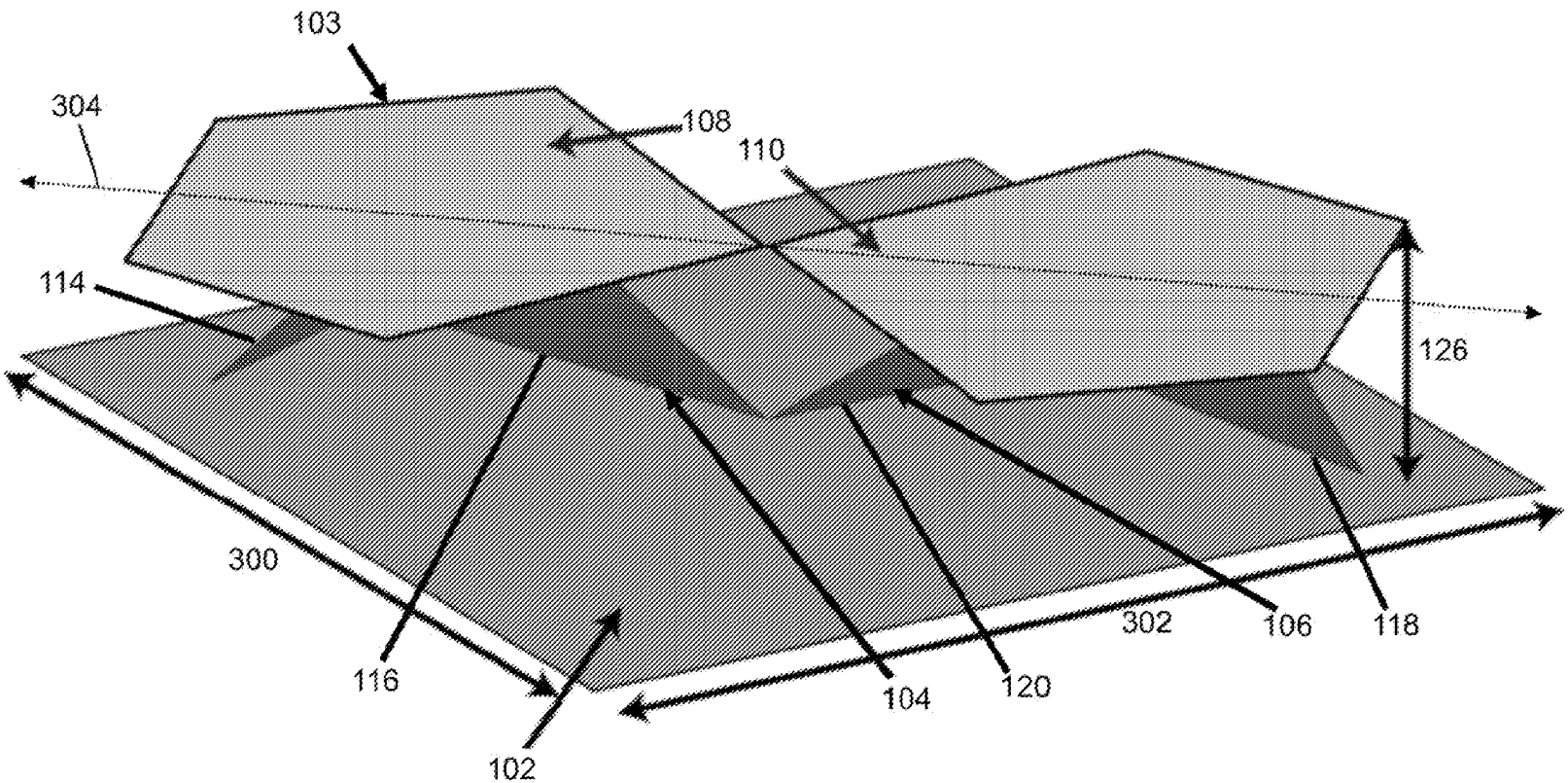
FIG. 3 is a perspective side view of the antenna of FIG. 1 in accordance with an illustrative embodiment.

With reference to the illustrative embodiment of FIGS. 1 to 3, third section 108 of first loop section 104 mounts to first section 116 and second section 114 of first loop section 104 along first edge 115, which forms a diagonal of the deltoid shape formed by first section 116 and second section 114 of first loop section 104 that does not include first end point 204, and third section 110 of second loop section 106 mounts to first section 120 and second section 118 of second loop section 106 along second edge 119, which forms a diagonal of the deltoid shape formed by first section 120 and second section 118 of second loop section 106 that does not include second end point 206. First end point 204 is centered within an angle formed between two sides of the pentagon shape formed by third section 108 of first loop section 104. Second end point 206 is centered within an angle formed between two sides of the pentagon shape formed by third section 110 of second loop section 106. A pentagon surface area defined by the pentagon shape formed by third section 108 of first loop section 104 is larger than a deltoid surface area defined by the deltoid shape formed by first section 116 and second section 114 of first loop section 104. Similarly, a pentagon surface area defined by the pentagon shape formed by third section 110 of second loop section 106 is larger than a deltoid surface area defined by the deltoid shape formed by first section 120 and second section 118 of second loop section 106. A pentagon diagonal extending from first end point 204 and bisecting the pentagon shape formed by third section 108 of first loop section 104 is approximately equal in length to a second diagonal of the deltoid shape formed by first section 116 and second section 114 of first loop section 104 that includes first end point 204. A pentagon diagonal extending from second end point 206 and bisecting the pentagon shape formed by third section 110 of second loop section 106 is approximately equal in length to a second diagonal of the deltoid shape formed by first section 120 and second section 118 of second loop section 106 that includes second end point 206.

With reference to FIG. 3, a side perspective view of antenna 100 is shown in accordance with an illustrative embodiment. In the illustrative embodiment of FIG. 3, first loop section 104 and second loop section 106 are oriented such that a ground plane diagonal 304 bisecting the pentagon shape formed by third section 108 of first loop section 104 and the pentagon shape formed by third section 110 of second loop section 106 is parallel to length 124 of radiating element 103. Ground plane substrate 102 may have any polygonal shape. In an illustrative embodiment, ground plane substrate 102 is rectangular and has a width 300 and a length 302. As examples, width 300 may be approximately $0.2\lambda_{min}$ and length 302 may be approximately $0.2\lambda_{min}$.

Figure 18:
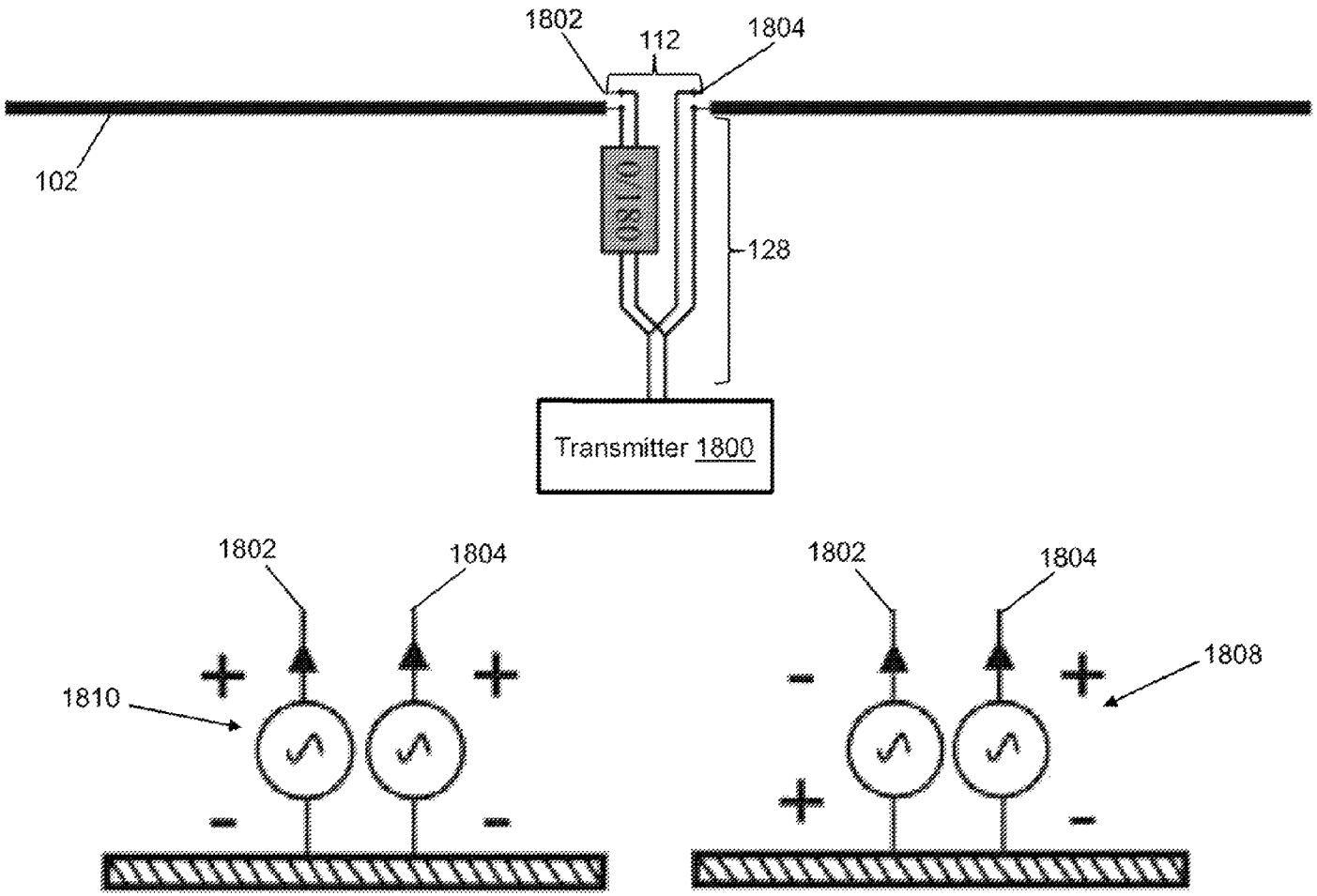
FIG. 18 depicts a feed network of an antenna in accordance with an illustrative embodiment.

With reference to FIG. 18, a transmitter and/or receiver or transceiver 1800 is connected to antenna 100 through feed network 128 and feed 112. Feed 112 may include a first input line 1802 connecting to first loop section 104 and a second input line 1804 connecting to second loop section 106. If antenna 100 includes additional loop sections, feed 112 may include additional input lines. Radiating element 103 is configured to radiate over a first frequency band when feed network 128 provides an in-phase input signal 1810 to first input line 1802 and second input line 1804 and to radiate over a second frequency band when feed network 128 provides an out-of-phase input signal 1808 to first input line 1802 and second input line 1804. The second frequency band includes a lower frequency than the first frequency band. Thus, the operational band of antenna 100 can be divided into two regions. In the first region, antenna 100 acts as a miniaturized, common mode antenna (CMA) and ultra-wideband operation is obtained in a frequency range extending from a lowest frequency of operation, $f_1$, to at least 3.0 gigahertz (GHz). However, since the CMA may be an extremely wideband antenna, a highest frequency of operation may be significantly higher than 3.0 GHz, for example, as high as 40.0 GHz or more. In the second mode of operation, antenna 100 is differentially fed to act as a wideband dipole antenna. The wideband dipole antenna can be optimized to operate from a lowest frequency such as 30-300 megahertz (MHz) up to at least $f_1$. As a result, a dual-mode antenna can be obtained that effectively covers a desired frequency range extending from 30 MHz to 40.0 GHz and above.

To achieve seamless operation between the two modes, a simple, passive, feed network may be used to feed antenna 100 in the appropriate mode based on the frequency of the input signal. For example, if antenna 100 is excited at 300 MHz, feed network 128 ensures that antenna 100 is excited differentially causing antenna 100 to radiate as a wideband dipole providing a lower frequency band of operation. Alternatively, if the frequency of the input signal is, for example, 2.0 GHz, antenna 100 is excited in-phase causing antenna 100 to radiate as a common mode coupled loop antenna providing a higher frequency band. As known to a person of skill in the art, various feed network circuits may be designed to provide the excitation. In an illustrative embodiment, a feed network circuit, which is essentially a simple, fixed power divider that provides a frequency dependent phase shift of 0° or 180° between two outputs, is used. After integrating antenna 100 and feed network 128, radiating element 103 acts as a single passive unit capable of operation over a bandwidth, for example, of 30 MHz to 40.0 GHz. As a result, antenna 100 operates as a dual-mode antenna, without requiring switching or tuning to select between modes. Feed network 128 operating as a frequency dependent feed network automatically provides the appropriate excitation mode based on the input frequency of the input signal received from transmitter 1800.

Figure 4:
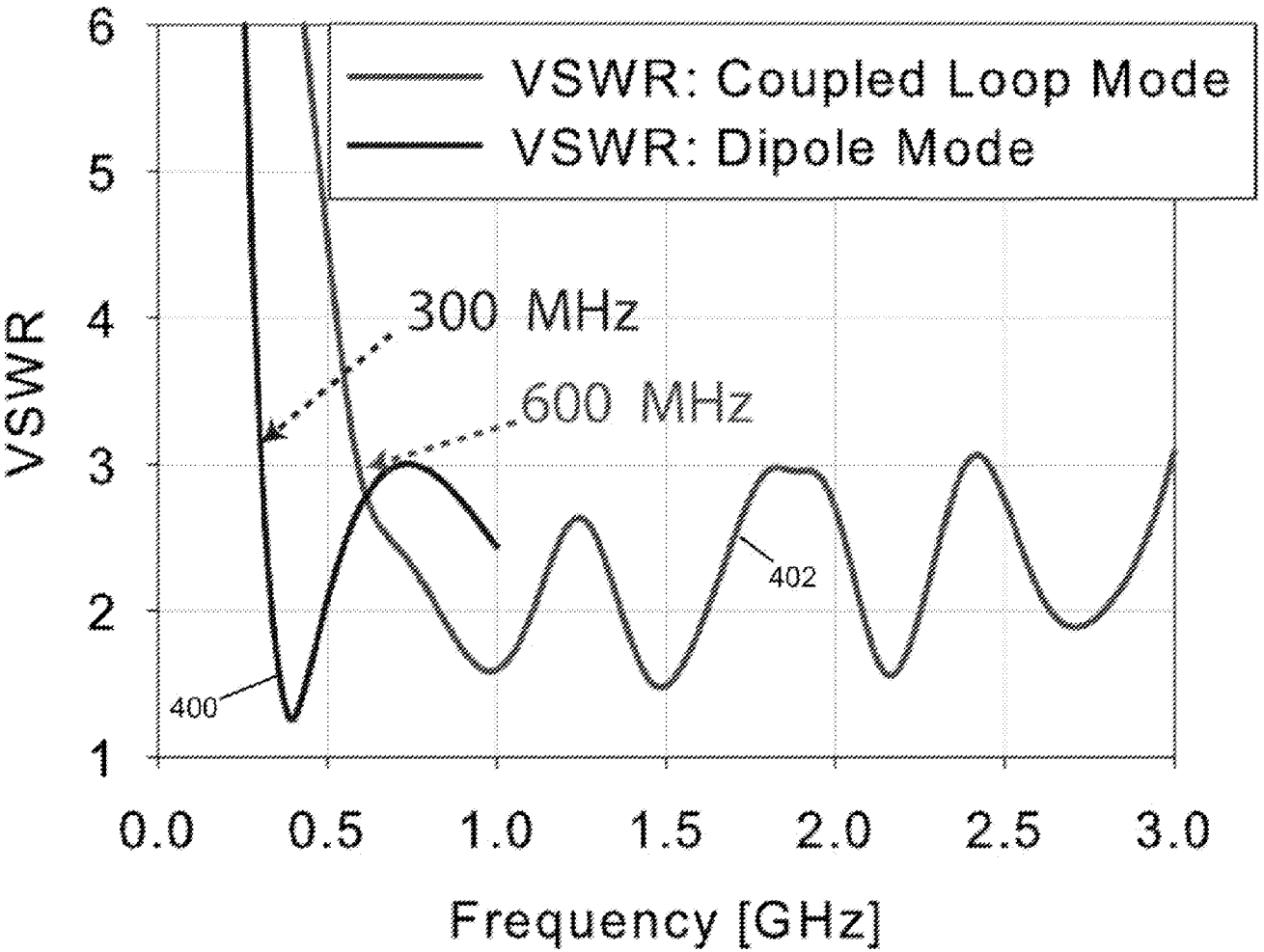
FIG. 4 is a graph showing a voltage standing wave ratio determined by simulating the performance of the antenna of FIGS. 1-3 when operating in a coupled loop mode and a wideband dipole mode.

With reference to FIG. 4, a graph showing a voltage standing wave ratio (VSWR) determined by simulating the performance of antenna 100 when operating in the coupled loop mode (CLM) and the wideband dipole mode (WDM) is provided in accordance with an illustrative embodiment. The simulated VSWR of antenna 100 in the CLM mode, shown by CLM curve 402 covers frequencies above 600 MHz. The simulated VSWR of antenna 100 in the WDM mode, shown by WDM curve 400 covers frequencies from approximately 300 MHz to approximately 600 MHz range.

Figure 5:
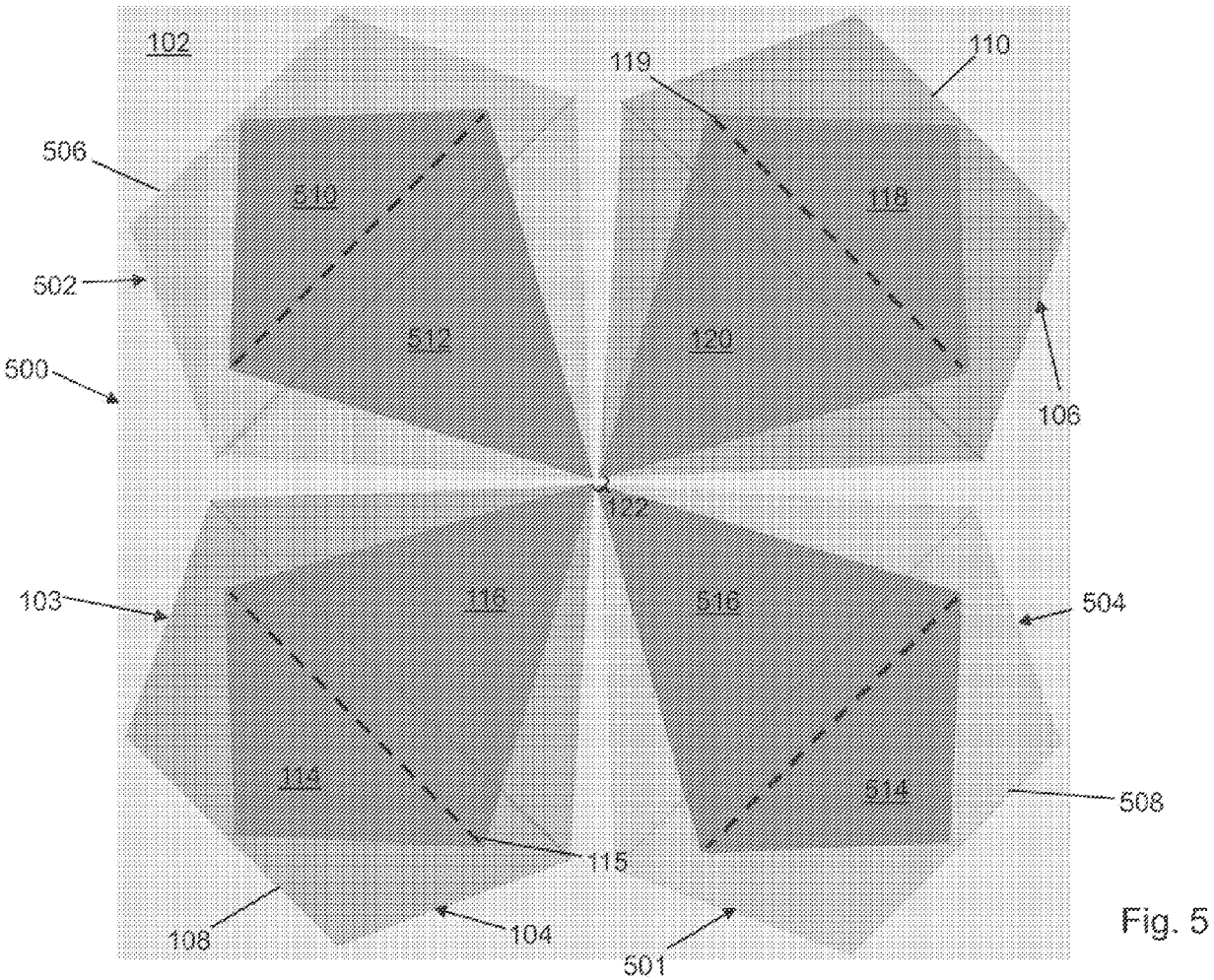
FIG. 5 is a top view of a second antenna in accordance with a second illustrative embodiment.

With reference to FIG. 5, a top view of a second antenna 500 is shown in accordance with a second illustrative embodiment. Second antenna 500 may include ground plane substrate 102, radiating element 103, and a second radiating element 501. In the illustrative embodiment, second radiating element 501 is structurally similar to radiating element 103. Second radiating element 501 may include a first loop section 502 and a second loop section 504. First loop section 502 of second radiating element 501 may be structurally similar to first loop section 104 of radiating element 103. First loop section 502 of second radiating element 501 may include a first section 512, a second section 510, and a third section 506. First section 512, second section 510, and third section 506 of first loop section 502 of second radiating element 501 may be structurally similar to first section 116, second section 114, and third section 108 of first loop section 104 of radiating element 103. Second loop section 504 of second radiating element 501 may include a first section 516, a second section 514, and a third section 508. First section 516, second section 514, and third section 508 of second loop section 504 of second radiating element 501 may be structurally similar to first section 120, second section 118, and third section 110 of second loop section 106 of radiating element 103.

Second radiating element 501 is configured to radiate over a first frequency band when feed network 128 provides an in-phase input signal 1810 to first loop section 502 and to second loop section 504 and to radiate over a second frequency band when feed network 128 provides an out-of-phase input signal 1808 to first loop section 502 and to second loop section 504. The second frequency band includes a lower frequency than the first frequency band. Thus, the operational band of antenna 500 can be divided into two regions similar to that described with reference to antenna 100.

In an illustrative embodiment, the two orthogonal structures, radiating element 103 and second radiating element 501, of second antenna 500 are fed through feed 112 with different relative phases. By appropriately choosing the phase shifts, second antenna 500 can be configured to obtain a directional radiation pattern or an enhanced omnidirectional pattern in the azimuth plane relative to antenna 100. The two orthogonal structures also can be placed in the same volume as that occupied by antenna 100.

Figure 6:
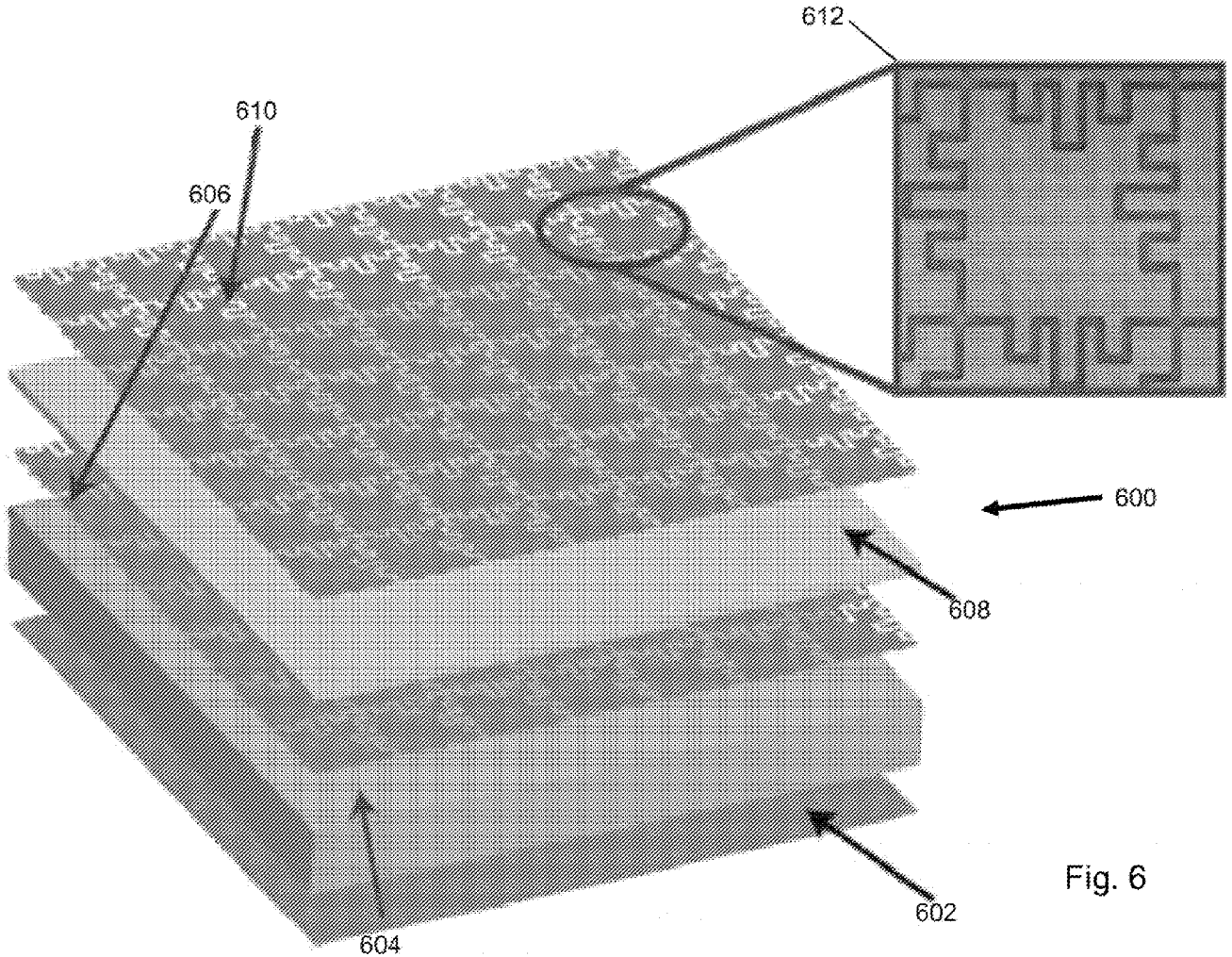
FIG. 6 is a schematic view of a metamaterial substrate used to form a ground plane of an antenna in accordance with an illustrative embodiment.
Figure 8:
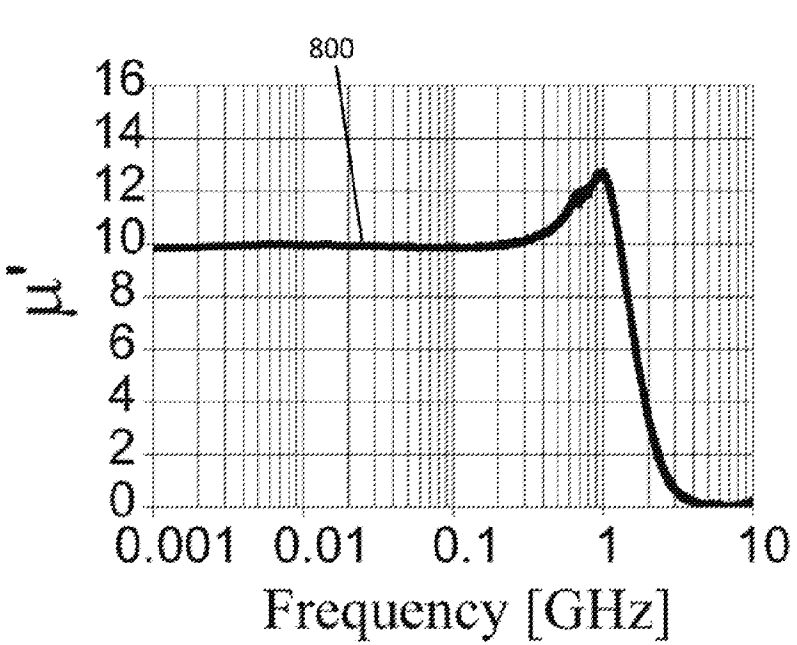
FIG. 8 is a graph showing a magnetic permeability of the metamaterial substrate of FIG. 6 in accordance with an illustrative embodiment.
Figure 7:
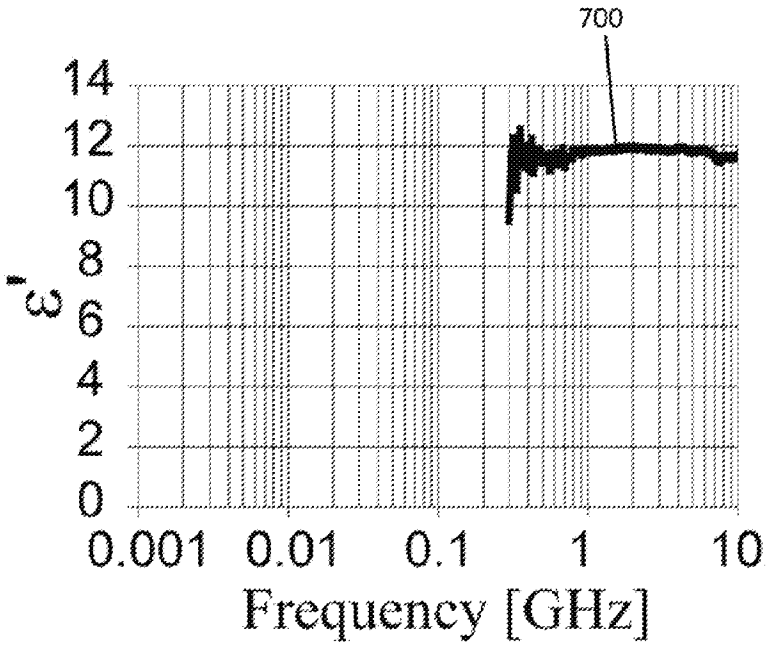
FIG. 7 is a graph showing an electric permittivity of the metamaterial substrate of FIG. 6 in accordance with an illustrative embodiment.

With reference to FIG. 6, a schematic view of a metamaterial substrate 600 used to form a ground plane of an antenna is shown in accordance with an illustrative embodiment. Any antenna described herein may use metamaterial substrate 600 as ground plane substrate 102. Use of metamaterial substrate 600 as ground plane substrate 102 can result in enhanced performance in the WDM mode of operation. The generalized topology shown with reference to FIG. 6 includes a ground plane layer 602, a first substrate layer 604, a first capacitive patch layer 606, a second substrate layer 608, and a second capacitive patch layer 610. In alternative embodiments, there may be a fewer or a greater number of capacitive patch layers. For example, an alternative metamaterial substrate may not include second substrate layer 608 and a second capacitive patch layer 610. Ground plane layer 602 is configured to form an electrical ground of metamaterial substrate 600. First substrate layer 604 is formed of a magnetic material and includes a first side and a second side. Illustrative magnetic materials include nickel-zinc ferrite, Co2Z (Ba3Co2Fe24O41), a variety of magnetic ceramic materials available from various manufacturers such as Trans-Tech Inc. a subsidiary of Skyworks Solutions, Inc. and TT electronics plc, etc. The first side of first substrate layer 604 is mounted to ground plane layer 602. First capacitive patch layer 606 is formed of a plurality of capacitive patches and includes a first side and a second side. The first side of first capacitive patch layer 606 is mounted to the second side of first substrate layer 604. Second substrate layer 608 is formed of a dielectric material and includes a first side and a second side. Illustrative dielectric materials include Teflon®, high frequency microwave laminates, FR-4 grade glass epoxy, etc. The first side of second substrate layer 608 is mounted to the second side of first capacitive patch layer 606. Second capacitive patch layer 610 is formed of a second plurality of capacitive patches and is mounted to the second side of second substrate layer 608. A capacitive patch layer is formed of a periodic arrangement of sub-wavelength capacitive patches 612. Short circuited first substrate layer 604 and second substrate layer 608 provide an inductive surface impedance and first capacitive patch layer 606 and second capacitive patch layer 610 provide a capacitive impedance for metamaterial substrate 600. The parallel combination of the inductive and capacitive impedances provides a high impedance surface that acts as an artificial magnetic conductor (AMC) at its resonant frequency. The bandwidth of this reactive impedance surface (RIS), when operated as an AMC, is defined to be the range of frequencies over which the phase of the reflection coefficient remains in the ±90° range. This bandwidth can be maximized by using a magneto-dielectric substrate that has a relatively large magnetic permeability. In an illustrative embodiment, metamaterial substrate 600 is Co2Z manufactured by Trans-Tech Corporation. With reference to FIGS. 7 and 8, the frequency dependent electric permittivity and magnetic permeability of the illustrative material Co2Z are shown in curves 700 and 800, respectively.

Figure 9:
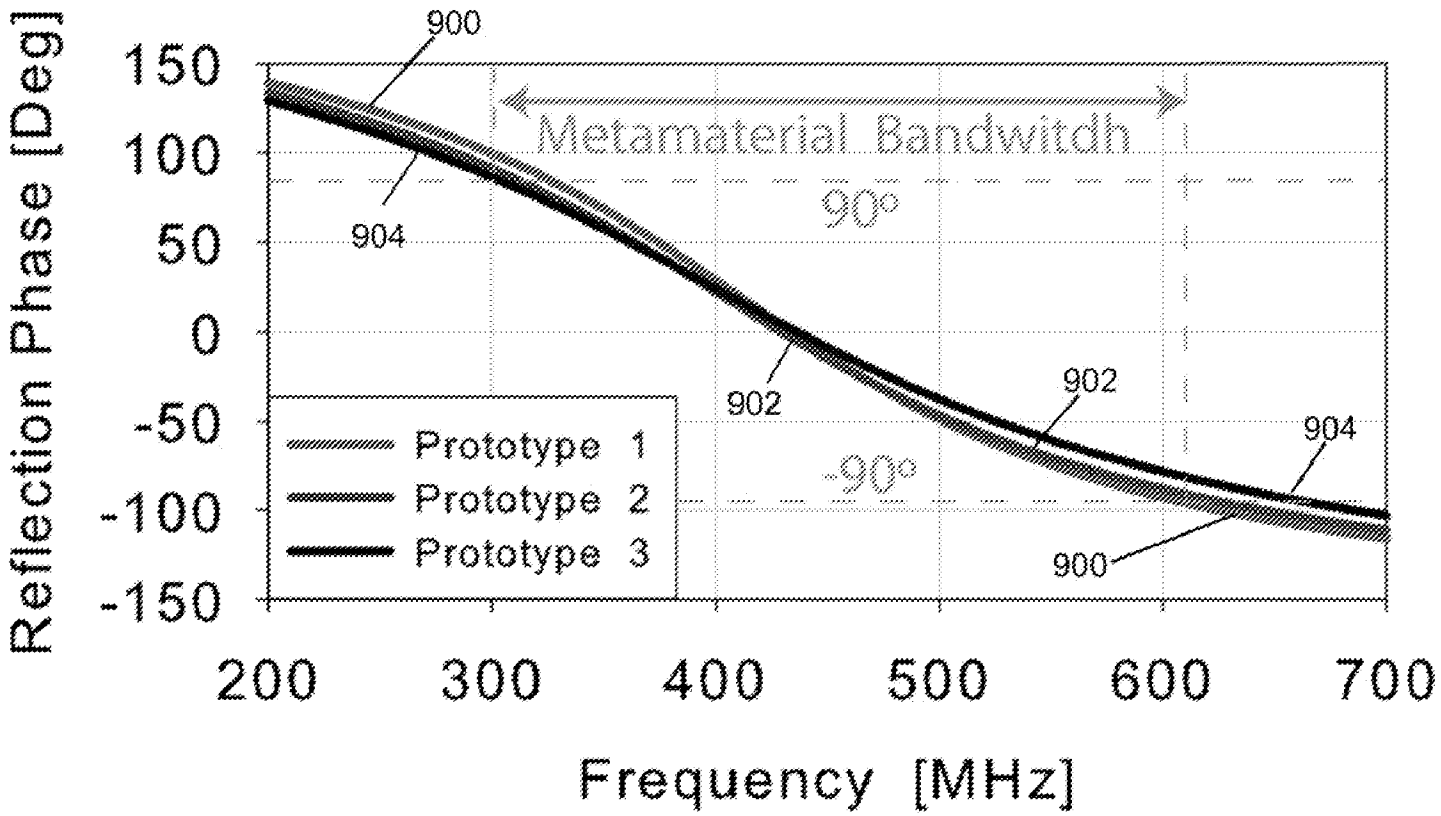
FIG. 9 is a graph showing a frequency response of a plurality of illustrative metamaterial substrates structured as shown in FIG. 6.

With reference to FIG. 9, a graph showing a frequency response of a plurality of illustrative metamaterial substrates is shown in accordance with illustrative embodiments. The graph of FIG. 9 shows a reflection phase as a function of frequency where the metamaterial bandwidth is defined as the values where the reflection phase has a value for the reflection phase between 90 and −90 degrees. A first curve 900 shows the reflection phase as a function of frequency for metamaterial substrate 600 having a thickness of approximately 7 millimeters (mm). A second curve 902 shows the reflection phase as a function of frequency for metamaterial substrate 600 having a thickness of approximately 8 mm. A third curve 904 shows the reflection phase as a function of frequency for metamaterial substrate 600 having a thickness of approximately 9 mm. As can be seen from the phase of reflection coefficient, the surface for each of the example prototype substrates acts as a wideband surface with more than one octave of usable RIS bandwidth. Though the examples shown demonstrate the operation of the proposed metamaterial substrate as an AMC, the same RIS topology can be used to synthesize very wideband RISs with different reactive surface impedances. This can be achieved by using the RIS topology shown in FIG. 6 and making minor modifications to the values of the surface capacitance and inductance of the structure.

Figure 10:
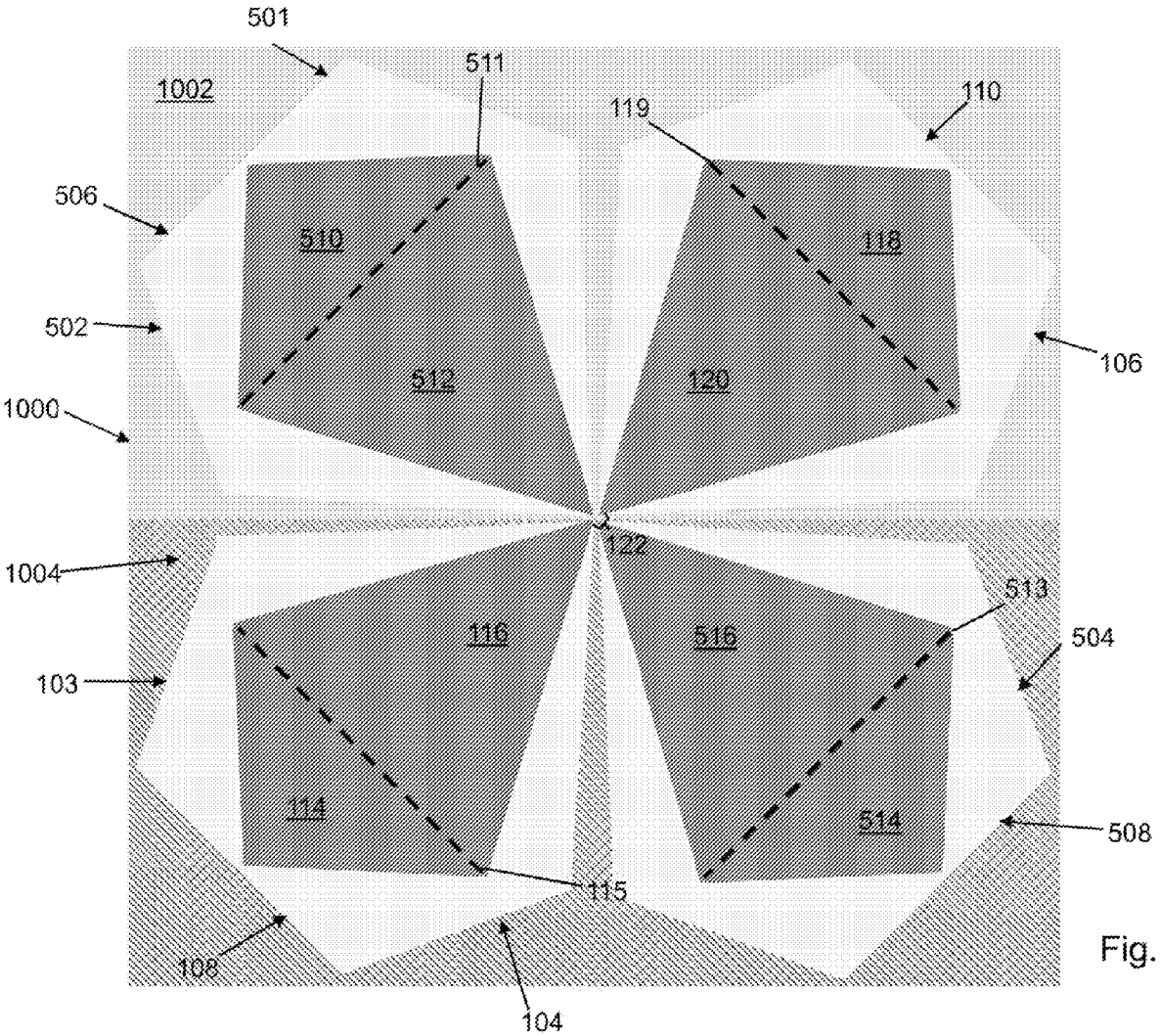
FIG. 10 is a top view of a third antenna in accordance with a third illustrative embodiment.

With reference to FIG. 10, a top view of a third antenna 1000 is shown in accordance with a third illustrative embodiment. Third antenna 1000 may include a first ground plane substrate 1002, a second ground plane substrate 1004, radiating element 103, and second radiating element 501. First ground plane substrate 1002 and second ground plane substrate 1004 are formed of two different materials having different reactive surface impedances. Each of the at least two loop sections is mounted to a different ground plane substrate. For example, first loop section 104 of radiating element 103 is mounted to second ground plane substrate 1004 and second loop section 106 of radiating element 103 is mounted to first ground plane substrate 1002, and first loop section 502 of second radiating element 501 is mounted to first ground plane substrate 1002 and second loop section 504 of second radiating element 501 is mounted to second ground plane substrate 1004.

The phase shift provided by each ground plane substrate 1002, 1004 can help shape the electric field distribution underneath third antenna 1000 and ensure that the radiating currents radiate in phase by optimizing the frequency response of the ground plane substrates 1002, 1004 to achieve a desired phase shift and in phase radiation from different sectors of third antenna 1000. As a result, third antenna 1000 may exhibit an enhanced gain along the azimuth plane at the lower operational frequencies as compared to second antenna 500. In an illustrative embodiment, first ground plane substrate 1002 is formed of a metal sheet and second ground plane substrate 1004 is formed of a metamaterial where the two different ground plane substrates are optimized to provide a desired phase shift that results in an in-phase radiation with the other half. The design of the antenna and the optimization of the surface impedances can be performed using computer aided design where one ground plane substrate is selected and the other ground plane substrate is optimized so that the surface impedance of the other ground plane substrate achieves a maximum enhanced radiation efficiency. The relative phase shift provided between first ground plane substrate 1002 and second ground plane substrate 1004 has been determined to be a more important characteristic than the absolute phase shift provided by each.

Figure 11:
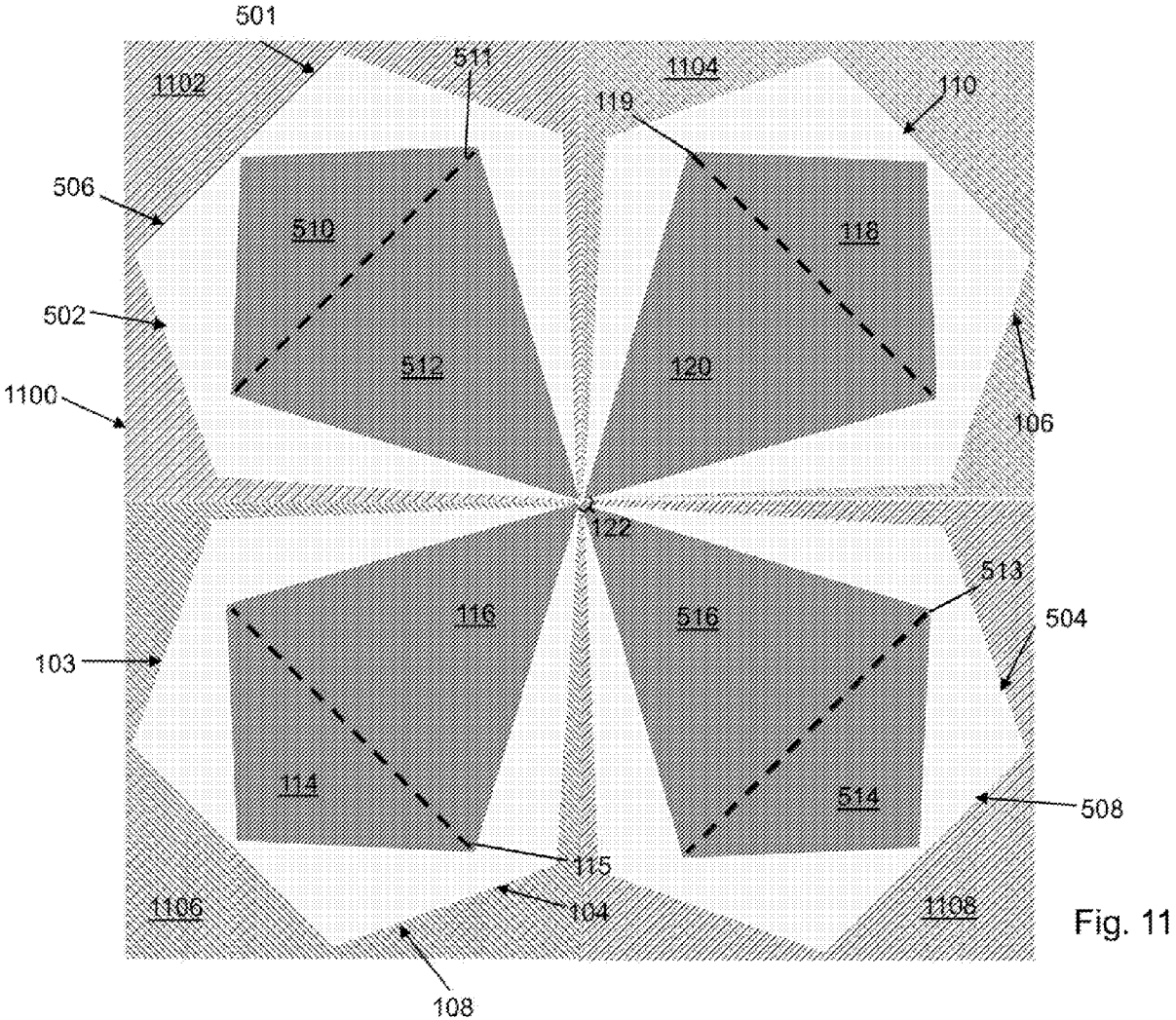
FIG. 11 is a top view of a fourth antenna in accordance with a fourth illustrative embodiment.

With reference to FIG. 11, a top view of a fourth antenna 1100 is shown in accordance with a fourth illustrative embodiment. Fourth antenna 1100 may include a first ground plane substrate 1102, a second ground plane substrate 1104, a third ground plane substrate 1106, a fourth ground plane substrate 1108, radiating element 103, and second radiating element 501. First ground plane substrate 1102, second ground plane substrate 1104, third ground plane substrate 1106, and fourth ground plane substrate 1108 are metamaterial substrates formed of four magneto-dielectric materials having different reactive surface impedances. Each of the at least two loop sections of radiating element 103 and second radiating element 501 is mounted to a different metamaterial substrate. For example, first loop section 104 of radiating element 103 is mounted to third ground plane substrate 1106, second loop section 106 of radiating element 103 is mounted to second ground plane substrate 1104, first loop section 502 of second radiating element 501 is mounted to first ground plane substrate 1102 and second loop section 504 of second radiating element 501 is mounted to fourth ground plane substrate 1108.

In an illustrative embodiment, the relative phase shift fed to each of the at least two loop sections of radiating element 103 and second radiating element 501 and the phase of the reflection coefficient of each of first ground plane substrate 1102, second ground plane substrate 1104, third ground plane substrate 1106, and fourth ground plane substrate 1108 are selected to adjust the direction of maximum radiation in a desired direction in the azimuth plane. In an illustrative embodiment, first ground plane substrate 1102, second ground plane substrate 1104, third ground plane substrate 1106, and fourth ground plane substrate 1108 are similar to each other, but optimized to provide different surface impedances using full-wave electro-magnetic simulations.

Figure 12:
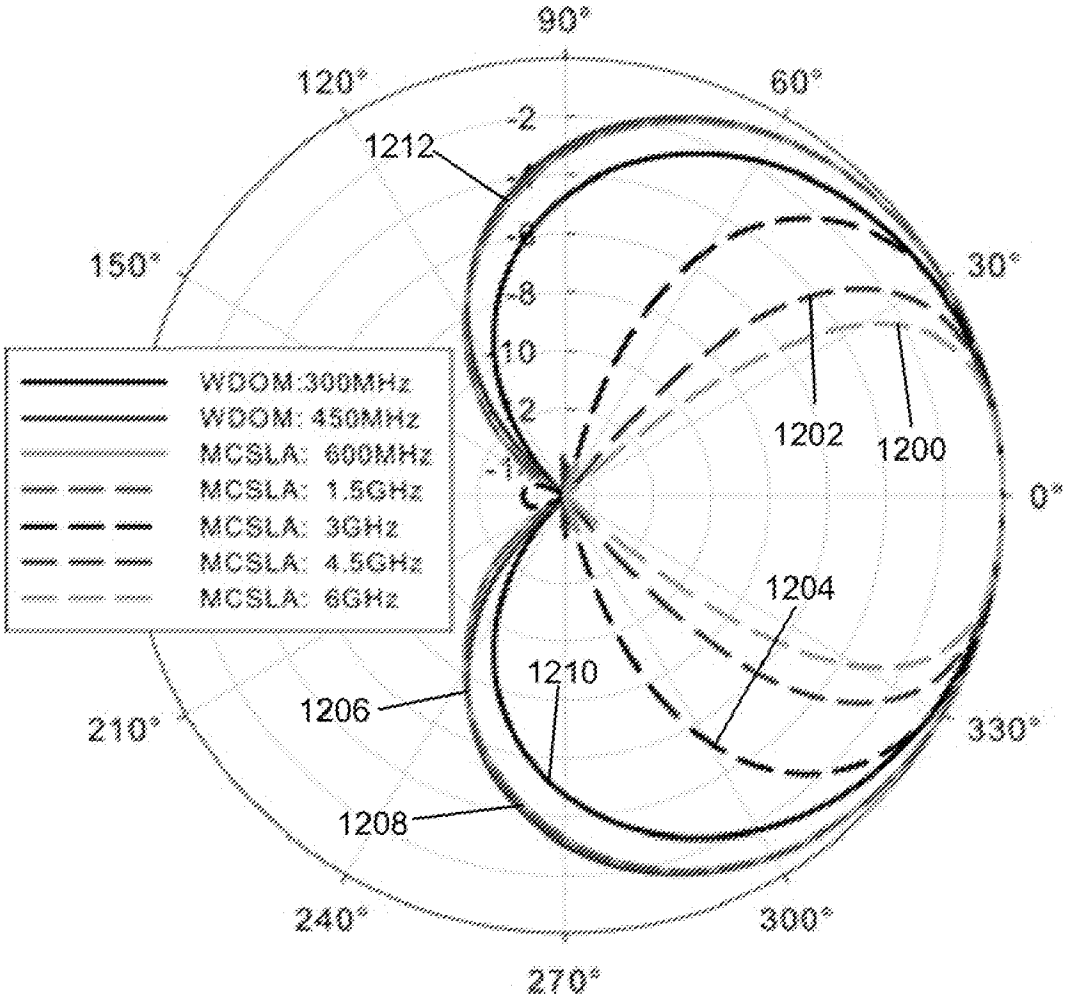
FIG. 12 is a graph showing directional radiation patterns in the azimuth planes obtained by optimizing the fourth antenna of FIG. 11 in accordance with an illustrative embodiment.

With reference to FIG. 12, a graph showing directional radiation patterns in the azimuth (and elevation) planes obtained by optimizing fourth antenna 1100 of FIG. 11 is shown. A first curve 1200 shows the representative response at a frequency of 6 GHz; a second curve 1202 shows the representative response at a frequency of 4.5 GHz; a third curve 1204 shows the representative response at a frequency of 3 GHz; a fourth curve 1206 shows the representative response at a frequency of 1.5 GHz; a fifth curve 1208 shows the representative response at a frequency of 600 MHz; a sixth curve 1210 shows the representative response at a frequency of 4506 MHz; and a seventh curve 1212 shows the representative response at a frequency of 300 MHz. As indicated in FIG. 12, the direction of maximum radiation does not change as the frequency is changed. The antenna's beamwidth is quite wide at low frequencies because the structure's electrical dimensions are extremely small. Nevertheless, even at the low frequencies, the antenna demonstrates better directional properties than a purely omnidirectional antenna, and the antenna's beamwidth decreases with increasing frequency while maintaining the direction of maximum radiation as desired.

Figure 13A:
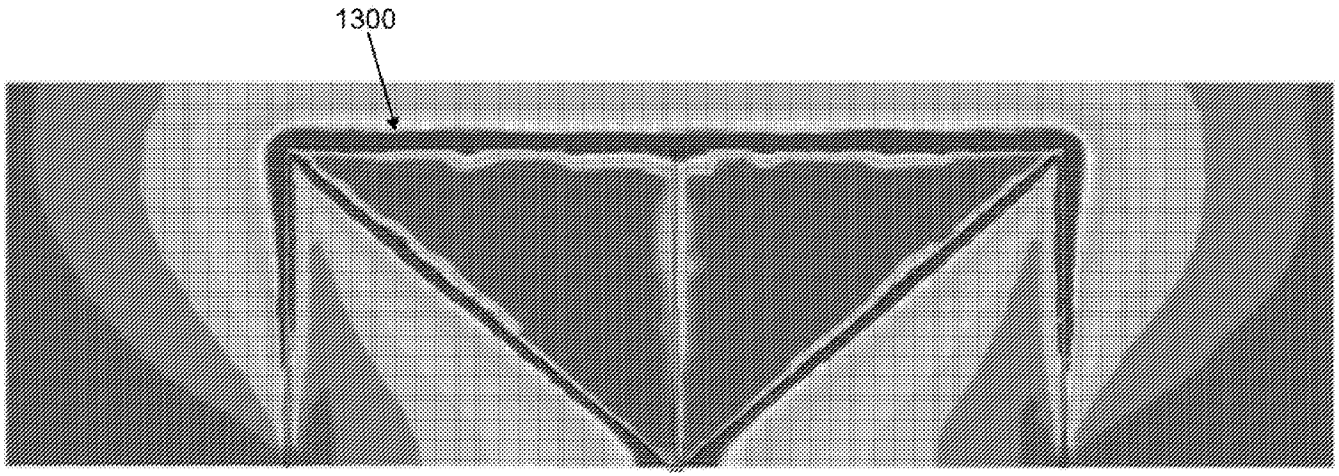
FIG. 13*a* is a graph showing an electric field distribution in the near field of the antenna of FIG. 1 in accordance with an illustrative embodiment.
Figure 13B:
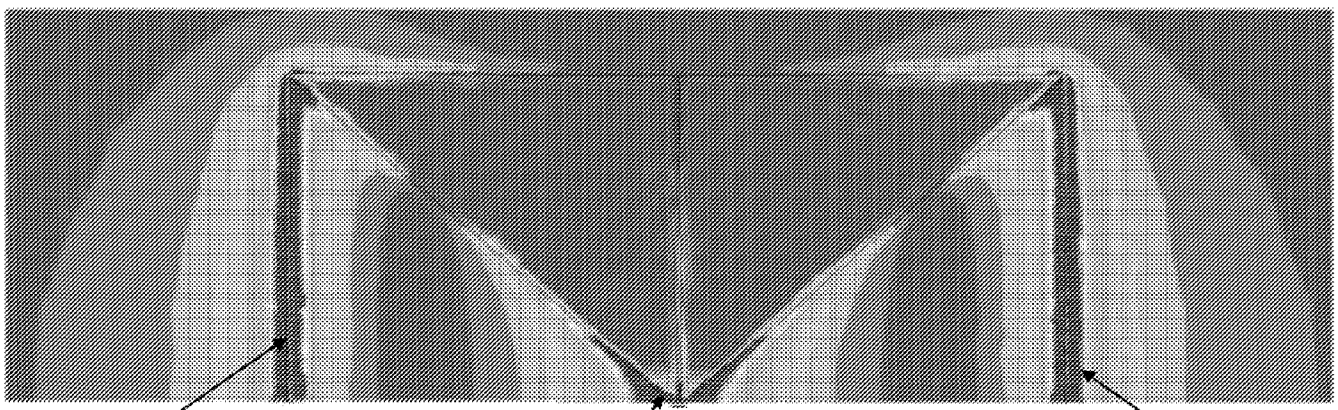
FIG. 13*b* is a graph showing a magnetic field distribution in the near field of the antenna of FIG. 1 in accordance with an illustrative embodiment.

With reference to FIG. 13*a*, a graph showing an electric field distribution 1300 in the near field of antenna 100 at its lowest frequency of operation is shown in accordance with an illustrative embodiment. With reference to FIG. 13*b*, a graph showing a magnetic field distribution 1400 in the near field of antenna 100 at its lowest frequency of operation is shown in accordance with an illustrative embodiment. As indicated in FIG. 13*a*, electric field distribution 1300 is strongest at the edges of the conductors of first loop section 104 and of second loop section 106. As indicated in FIG. 13*b*, magnetic field distribution 1400 is strongest at the edges of the conductors of first section 116 of first loop section 104 and first section 120 of second loop section 106 and at the edges of the conductors of second section 114 of first loop section 104 and second section 118 of second loop section 106. This is expected because the strongest current densities usually occur at the edges of the conductors. Thus, there is a considerable overlap between the two regions.

A technique that can be used to reduce the size of any antenna is to load a surface of the antenna with a high-K material, i.e., a material having a high dielectric constant. This technique can be used to roughly reduce the size of the antenna by a factor of $\in_r^{1/2}$, where $\in_r$ is the relative permittivity of the high-K material used for miniaturization. However, the main drawback of this technique is that it significantly reduces the bandwidth of the antenna because the quality factor, Q, of such an antenna is proportional to the ratio of the net stored energy in the vicinity of the antenna to the radiated power assuming that losses are small and loading the antenna with a high-K dielectric results in increasing the net stored energy in the vicinity of the antenna which increases its Q or equivalently reduces its bandwidth. To effectively utilize this technique in miniaturizing an antenna without sacrificing its bandwidth, the stored electric energy in a high-K material can be balanced with a stored magnetic energy in a high-μ material, i.e., a material having a high magnetic permeability constant. Because the net stored energy is the difference between the stored electric and magnetic energies in the near field of the antenna, if the stored electric energy is balanced with an equal amount of stored magnetic energy, a miniaturization factor of $(\in_r\mu_r)^{1/2}$ can be achieved without sacrificing the antenna bandwidth. To effectively use this approach while ensuring that the antenna weight is not increased, the antenna can be loaded (coated) with very thin layers of high-μ magnetic/high-K dielectric materials only at locations where the magnetic/electric field is strongest. A material having a static relative permittivity larger than approximately 5-6 can be considered a high-K dielectric material. A material having a relative magnetic permeability larger than approximately 5-6 can be considered a high-μ magnetic material.

Figure 14:
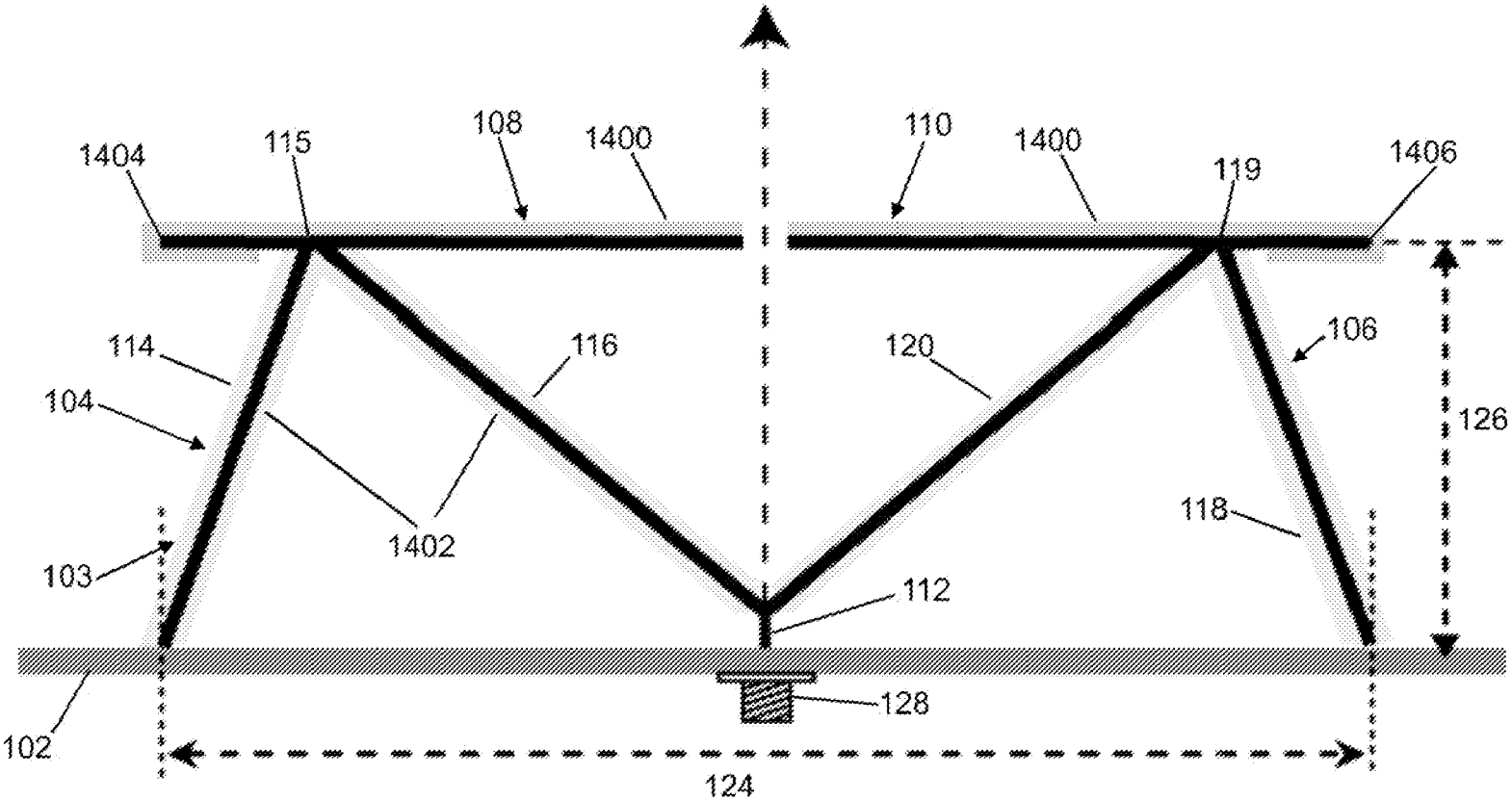
FIG. 14 is a side view of a fifth antenna in accordance with a fifth illustrative embodiment.

With reference to FIG. 14, a side view of a fifth antenna 1400 is shown in accordance with a fifth illustrative embodiment. Fifth antenna 1400 may include ground plane substrate 102, radiating element 103, a high-K dielectric material 1400, and a high-μ magnetic material 1402. In the illustrative embodiment of FIG. 14, antenna 100 is loaded/coated with relatively thin layers of high-K dielectric material 1400 and high-μ magnetic material 1402. High-K dielectric material 1400 is loaded on a top surface and around an edge 1404 of third section 108 of first loop section 104 and on a top surface and around an edge 1406 of third section 110 of second loop section 106. High-μ magnetic material 1402 is loaded on a top and a bottom surface of first section 116 and second section 114 of first loop section 104 and on a top and a bottom surface of first section 120 and second section 118 of second loop section 106. For example, thin layers of high-μ magnetic material 1402 with $\mu_r \approx 10$ and high-K dielectric material 1400 $\in_r \approx 10$ are loaded on antenna 100 to form fifth antenna 1400. In an illustrative embodiment, the thickness of high-μ magnetic material 1402 and high-K dielectric material 1400 is approximately 1-2 mm. In general, the higher the dielectric permittivity and the magnetic permeability, the lower the thickness of the material may be. Of course, loading of the antenna may be used with any antenna design described herein.

Figure 15:
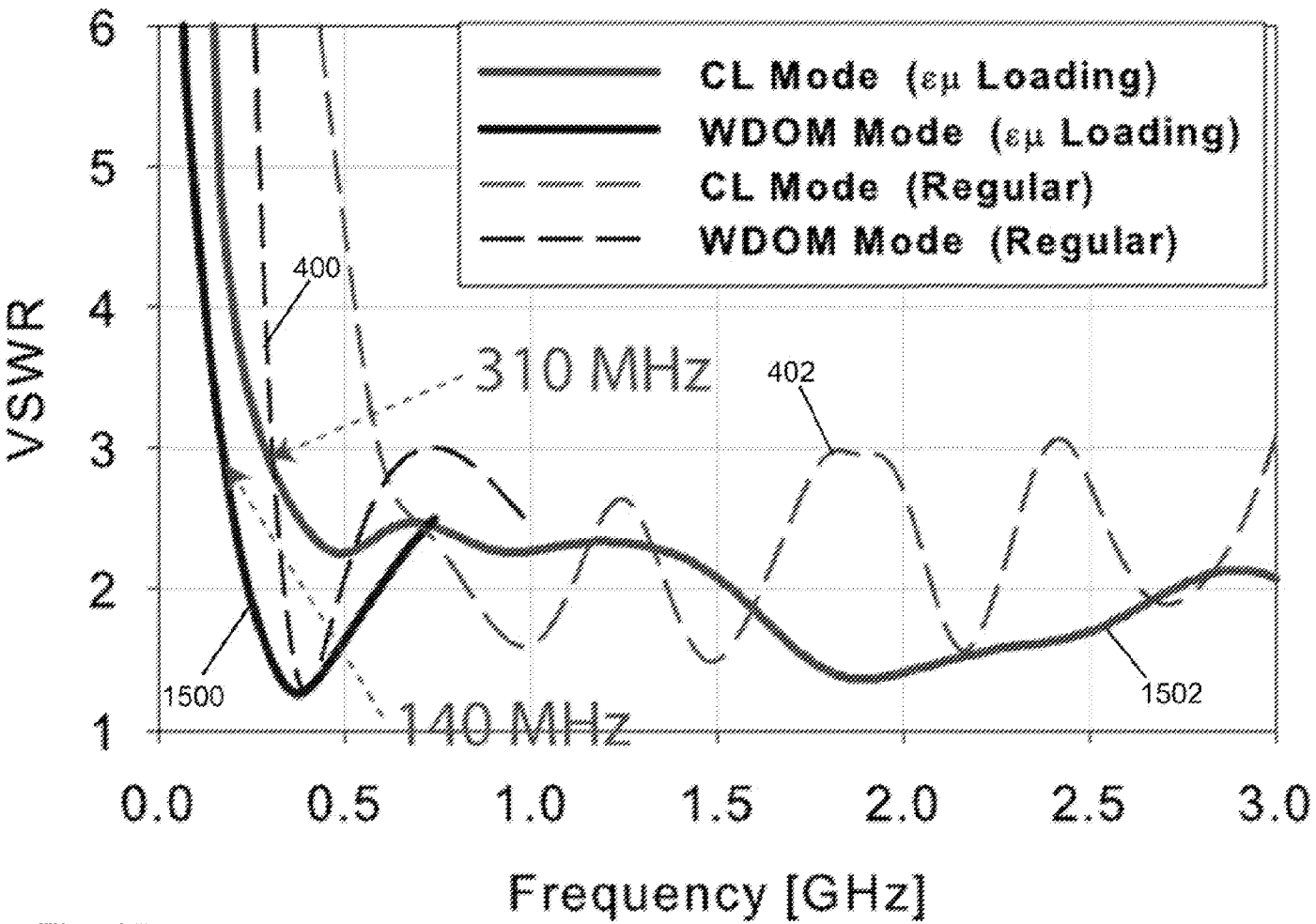
FIG. 15 is a graph comparing a voltage standing wave ratio determined by simulating the performance of the antenna of FIG. 1 when operating in a coupled loop mode and a wideband dipole mode with the performance of the antenna of FIG. 14 when operating in a coupled loop mode and a wideband dipole mode.

With reference to FIG. 15, a graph comparing a VSWR determined by simulating the performance of the antenna of FIG. 1 when operating in a coupled loop mode and a wideband dipole mode as shown with reference to FIG. 4 with the performance of fifth antenna 1400 when operating in a coupled loop mode and a wideband dipole mode. The simulated VSWR of fifth antenna 1400 in the CLM mode, shown by second CLM curve 1502 covers frequencies above 310 MHz. The simulated VSWR of fifth antenna 1400 in the WDM mode, shown by second WDM curve 1500 covers frequencies from approximately 140 MHz to approximately 600 MHz range. As shown with reference to the illustrative embodiment of FIG. 16, the lowest frequency of operation of fifth antenna 1400 is reduced by approximately a factor of 2. Further miniaturization can be achieved by using magneto-dielectric materials with higher $\in_r$ and $\mu_r$ values that are commercially available. An example of a magnetic material is Co2Z with $\mu_r$=10, and an example of a dielectric material is Rogers 5880 with $\in_r$=12, which are commercially available from a number of manufacturers such as Trans-Tech Inc. a subsidiary of Skyworks Solutions, Inc., TT electronics plc, Rogers Corporation, etc.

Figure 16:
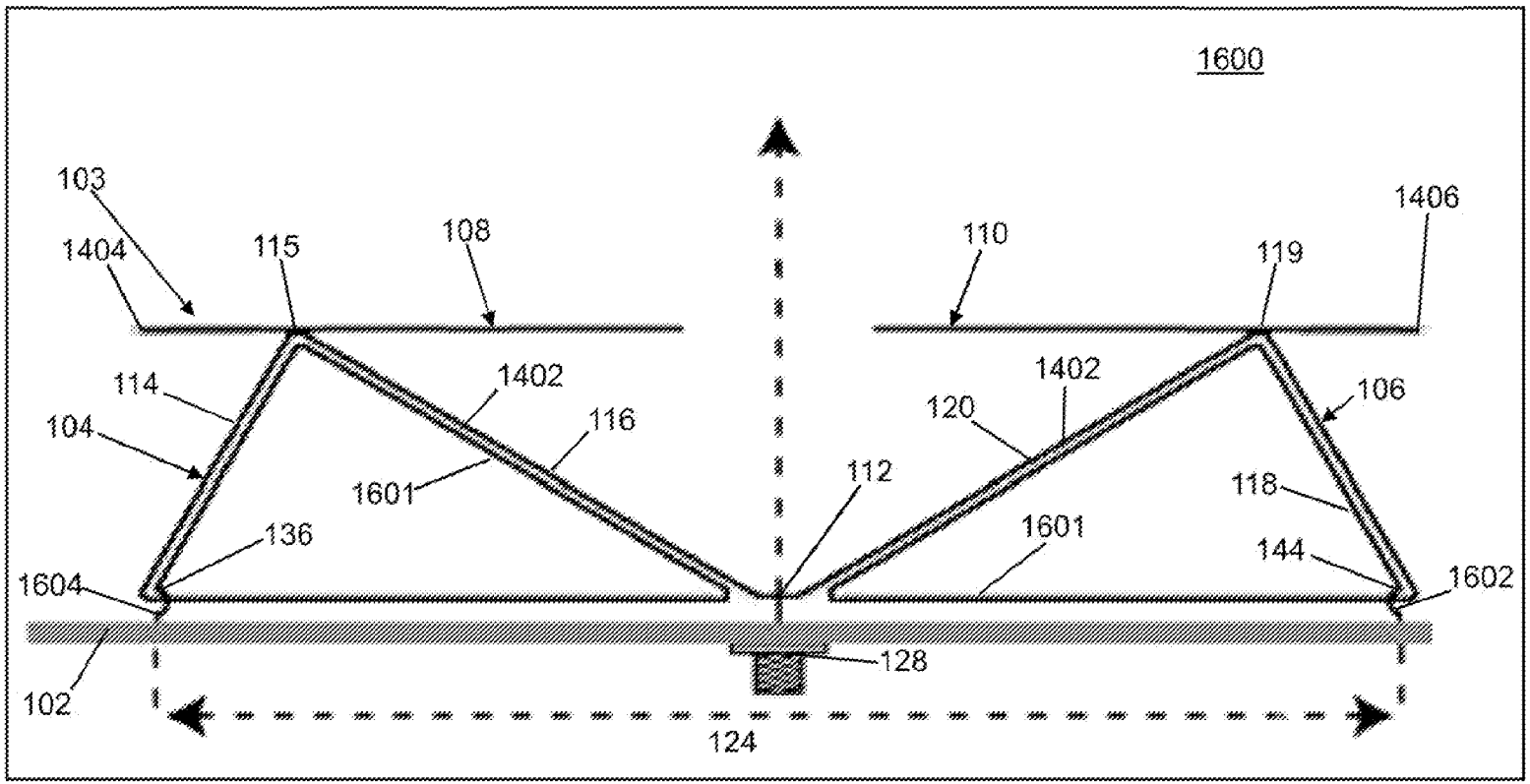
FIG. 16 is a side view of a sixth antenna in accordance with a sixth illustrative embodiment.

With reference to FIG. 16, a side view of a sixth antenna 1600 is shown in accordance with a sixth illustrative embodiment. Sixth antenna 1600 may include ground plane substrate 102 and radiating element 103. In the illustrative embodiment of FIG. 16, first section 116 of first loop section 104, second section 114 of first loop section 104, first section 120 of second loop section 106, and second section 118 of second loop section 106 are formed of a multi-turn loop 1601. Multi-turn loop 1601 includes a first loop point 1604 mounted to ground plane substrate 102 and fourth end 136 of second section 114 of first loop section 104 and a second loop point 1602 mounted to ground plane substrate 102 and fourth end 144 of second section 118 of second loop section 106. High-K dielectric material may be loaded on a top surface and around an edge 1404 of third section 108 of first loop section 104 and on a top surface and around an edge 1406 of third section 110 of second loop section 106. High-μ magnetic material 1402 may be loaded between the loop sections formed in first section 116 and second section 114 of first loop section 104 and in first section 120 and second section 118 of second loop section 106.

Figure 17:
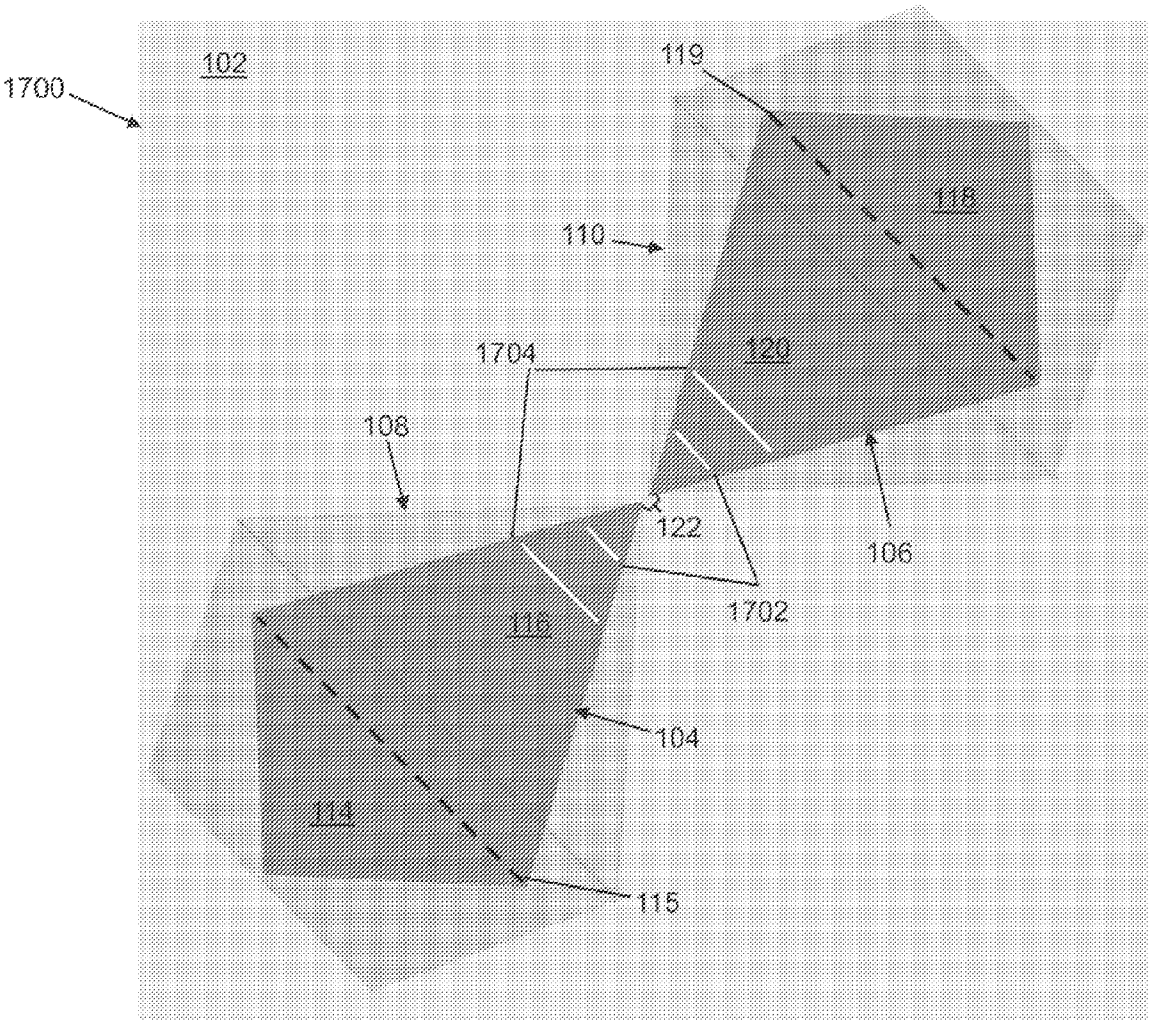
FIG. 17 is a top view of a seventh antenna in accordance with a seventh illustrative embodiment.

As frequency increases, the electrical dimensions of antenna 100 and its finite ground plane increase as well. Therefore, at such frequencies, radiation emanating from different parts of antenna 100 either adds constructively or destructively in different directions resulting in an interference pattern. This manifests itself in the form of ripples in the radiation pattern. Additionally, scattering and diffraction from the edges of ground plane substrate 102 adds to these effects and further deteriorates the radiation pattern of antenna 100. With reference to FIG. 17, a top view of a seventh antenna 1700 is shown in accordance with a seventh illustrative embodiment to reduce these effects. Seventh antenna 1700 may include ground plane substrate 102 and radiating element 103. In the illustrative embodiment of FIG. 17, first section 116 of first loop section 104 and first section 120 of second loop section 106 include a first slit 1702 and a second slit 1704 formed in a surface of first section 116 of first loop section 104 and first section 120 of second loop section 106 to provide a frequency dependent reduction in an effective radiation region of seventh antenna 1700. Seventh antenna 1700 may include a fewer or a greater number of slits.

First slit 1702 and second slit 1704 are narrow slits, with relatively small lengths cut into first section 116 of first loop section 104 and first section 120 of second loop section 106. For example, first slit 1702 and second slit 1704 may be etched or milled into first section 116 of first loop section 104 and first section 120 of second loop section 106. First slit 1702 and second slit 1704, however, are not cut through first section 116 of first loop section 104 and first section 120 of second loop section 106. At low frequencies, first slit 1702 and second slit 1704 are significantly smaller than a wavelength and have no effect on the performance of seventh antenna 1700. However, as frequency increases, the dimensions of first slit 1702 and second slit 1704 become comparable to the wavelength and, at a certain frequency, attain resonance creating a high-impedance load in the path of the current flowing in first loop section 104 and second loop section 106, which in turn limits the radiating components of the electric current to the region defined by the position of first slit 1702 and second slit 1704.

The width of first slit 1702 and second slit 1704 is relatively small. For example, the widths are in the range from approximately 0.4-1.0 mm. The length of first slit 1702 and second slit 1704 is selected such that they are resonant at the desired frequency. For example, at 3.0 GHz, the length of a slit should be roughly half a wavelength or 5 centimeters (cm). If there is insufficient physical space to accommodate a straight slit, a curved slit or a slit loaded with one or more capacitors may be used. The position of the slit is determined based on the desired frequency of operation. For example, at 3 GHz, an antenna having lateral dimensions of 20 cm×20 cm corresponds to 22λ×2λ. To limit the radiating range of the antenna to, for example, 10 cm×10 cm, first slit 1702 may be positioned 5 cm away from first end 130 of first section 116 of first loop section 104 and, respectively, from the feed point. and second slit 1704 may be positioned 5 cm away from first end 138 of first section 120 of second loop section 106.

The word "illustrative" is used herein to mean serving as an illustrative, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise.

The foregoing description of illustrative embodiments of the invention have been presented for purposes of illustration and of description. It is not intended to be exhaustive or to limit the invention to the precise form disclosed, and modifications and variations are possible in light of the above teachings or may be acquired from practice of the invention. For example, aspects of the various embodiments may be combined to form further additional embodiments. The illustrative embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. An antenna comprising:

a ground plane substrate; and a radiating element comprising at least two loop sections, wherein each of the at least two loop sections is electrically connected to a feed network and to the ground plane substrate, wherein the radiating element is configured to radiate over a first frequency band when the feed network provides an in-phase input signal to the at least two loop sections and to radiate over a second frequency band when the feed network provides an out-of-phase input signal to the at least two loop sections, wherein the second frequency band includes a lower frequency than the first frequency band.

2. The antenna of claim 1, wherein a first loop section of the at least two loop sections comprises:

a first section comprising a first end and a second end, wherein the first end is electrically connected to the feed network;

a second section comprising a third end and a fourth end, wherein the third end is mounted to the second end, and the fourth end is mounted to the ground plane substrate; and a third section mounted to the second end and to the third end.

3. The antenna of claim 2, wherein the third section is generally planar and oriented in a first plane approximately parallel to a second plane defined by the ground plane substrate.

4. The antenna of claim 3, wherein the third section has a pentagon shape when projected into the second plane.

5. The antenna of claim 4, wherein at least a portion of a surface area of the pentagon shape of the third section is coated with a dielectric material.

6. The antenna of claim 2, wherein the third end is mounted to the second end to form two sides of a triangle extending above the ground plane when projected into a third plane perpendicular to a second plane defined by the ground plane substrate and extending through the ground plane substrate.

7. The antenna of claim 6, wherein the third section is mounted to the second end and the third end along an edge joining the third end and the second end.

8. The antenna of claim 7, wherein the first section and the second section together have a quadrilateral shape when projected into the second plane.

9. The antenna of claim 8, wherein the third section is mounted to the second end and the third end along a diagonal of the quadrilateral shape.

10. The antenna of claim 6, wherein a second loop section of the at least two loop sections is mounted as a mirror image of the first loop section of the at least two loop sections.

11. The antenna of claim 10, wherein the first section and the second section together have a deltoid shape when projected into the second plane.

12. The antenna of claim 11, wherein the second loop section is mounted to form a gap between a first end point of the deltoid shape of the first loop section and a second end point of the deltoid shape of the second loop section.

13. The antenna of claim 12, wherein the first end point is at a first tip of the long edges of the deltoid shape of the first loop section and the second end point is at a second tip of the long edges of the deltoid shape of the second loop section.

14. The antenna of claim 13, wherein the third section is mounted to the second end and the third end along a first diagonal of the deltoid shape, wherein the first diagonal does not include the first end point.

15. The antenna of claim 14, wherein the third section has a pentagon shape when projected into the second plane, and further wherein the first end point is centered within an angle formed between two sides of the pentagon shape.

16. The antenna of claim 15, wherein a pentagon surface area defined by the pentagon shape is larger than a deltoid surface area defined by the deltoid shape.

17. The antenna of claim 15, wherein a pentagon diagonal of the pentagon shape extending from the angle and bisecting the pentagon shape is approximately equal in length to a second diagonal of the deltoid shape including the first end point.

18. The antenna of claim 2, wherein the first section and the second section are coated with a magnetic material.

19. The antenna of claim 2, wherein the first section and the second section are formed of a multi-turn loop.

20. The antenna of claim 2, wherein the first section comprises a slit formed in a surface of the first section to provide a frequency dependent reduction in an effective radiation region of the first section.

21. The antenna of claim 1, comprising a plurality of radiating elements.

22. The antenna of claim 1, wherein the second frequency band includes a frequency of 300 megahertz.

23. The antenna of claim 22, wherein the first frequency band includes a frequency of 3 gigahertz such that a bandwidth supported by the antenna includes a frequency range of 300 megahertz to 3 gigahertz.

24. The antenna of claim 1, wherein the second frequency band includes a frequency of 30 megahertz.

25. The antenna of claim 24, wherein the first frequency band includes a frequency of 3 gigahertz such that a bandwidth supported by the antenna includes a frequency range of 30 megahertz to 3 gigahertz.

26. The antenna of claim 1, further comprising the feed network configured to generate the in-phase input signal when excited at a first frequency and to generate the out-of-phase input signal when excited at a second frequency.

27. The antenna of claim 1, wherein the ground plane substrate is formed of a magneto-dielectric material.

28. The antenna of claim 1, wherein the ground plane substrate comprises:

a ground plane layer configured to form an electrical ground;

a first substrate layer formed of a magnetic material and including a first side and a second side, wherein the first side is mounted to the ground plane layer;

a first capacitive patch layer formed of a plurality of capacitive patches and including a first side and a second side, wherein the first side is mounted to the second side of the first substrate layer;

a second substrate layer formed of a dielectric material and including a first side and a second side, wherein the first side is mounted to the second side of the first capacitive patch layer; and a second capacitive patch layer formed of a second plurality of capacitive patches and mounted to the second side of the second substrate layer.

29. The antenna of claim 1, wherein the ground plane substrate is formed of a plurality of magneto-dielectric materials having different surface impedances with each of the at least two loop sections mounted to a different magneto-dielectric material.

30. The antenna of claim 29, comprising a plurality of radiating elements.

31. An antenna comprising:

a ground plane substrate formed of at least four magneto-dielectric materials having different surface impedances;

a first radiating element comprising two loop sections, wherein each of the two loop sections of the first radiating element is electrically connected to a feed network and to the ground plane substrate; and a second radiating element comprising two loop sections wherein each of the two loop sections of the second radiating element is electrically connected to the feed network and to the ground plane substrate;

wherein each of the two loop sections of the first radiating element and each of the two loop sections of the second radiating element is electrically connected to a different magneto-dielectric material of the ground plane substrate; and further wherein the feed network provides an input signal to each loop section of the first radiating element and of the second radiating element, where the input signal to each has a different phase selected to define a direction of a radiation pattern generated by the first radiating element and the second radiating element.

* * * * *